United States Patent [19]

Yasui

[11] 4,173,793

[45] Nov. 13, 1979

[54] KNOT RETAINING IMPLEMENT FOR NECKTIE OR SCARF

[76] Inventor: Yasui Kazuo, No. 2-3-813, 3-chome, Taishibashi, Asahi-ku, Osaka, Japan

[21] Appl. No.: 891,113

[22] Filed: Mar. 28, 1978

[30] Foreign Application Priority Data

| | | | |
|---|---|---|---|
| Apr. 11, 1977 | [JP] | Japan | 52-45387 |
| Jul. 9, 1977 | [JP] | Japan | 52-91332 |
| Jul. 9, 1977 | [JP] | Japan | 52-91333 |
| Oct. 31, 1977 | [JP] | Japan | 52-146558 |
| Dec. 2, 1977 | [JP] | Japan | 52-162313 |
| Dec. 2, 1977 | [JP] | Japan | 52-162314 |

[51] Int. Cl.[2] ..... A41D 25/14

[52] U.S. Cl. ..... 2/152 A; 2/153; 24/49 CF; 24/56

[58] Field of Search ..... 2/145, 152 R, 152 A, 2/153; 24/49 CF, 56

[56] References Cited

U.S. PATENT DOCUMENTS

| | | | |
|---|---|---|---|
| 701,154 | 5/1902 | Cole | 2/152 A |
| 1,318,248 | 10/1919 | Willey | 2/152 A |
| 1,707,591 | 4/1929 | Young | 24/49 CF |
| 1,982,188 | 11/1934 | Wurster | 24/49 CF |
| 2,157,623 | 5/1939 | Nugent | 2/153 |
| 2,434,821 | 1/1948 | Ulrich | 2/152 A |
| 2,557,635 | 6/1951 | Cregar | 24/56 X |
| 3,026,530 | 3/1962 | Gruber | 2/153 |
| 3,628,220 | 12/1971 | Alibrandi | 24/56 |

FOREIGN PATENT DOCUMENTS

| | | | |
|---|---|---|---|
| 14206 | of 1903 | United Kingdom | 2/145 |

*Primary Examiner*—Louis Rimrodt

*Attorney, Agent, or Firm*—Wenderoth, Lind & Ponack

[57] ABSTRACT

A knot retaining implement for a necktie or scarf comprises a substantially V-shaped retaining portion of wire and a hook portion which extends backwardly from each end of the retaining portion. A chain may be attached to the hook portion for preventing a necktie from swaying untidily.

4 Claims, 28 Drawing Figures

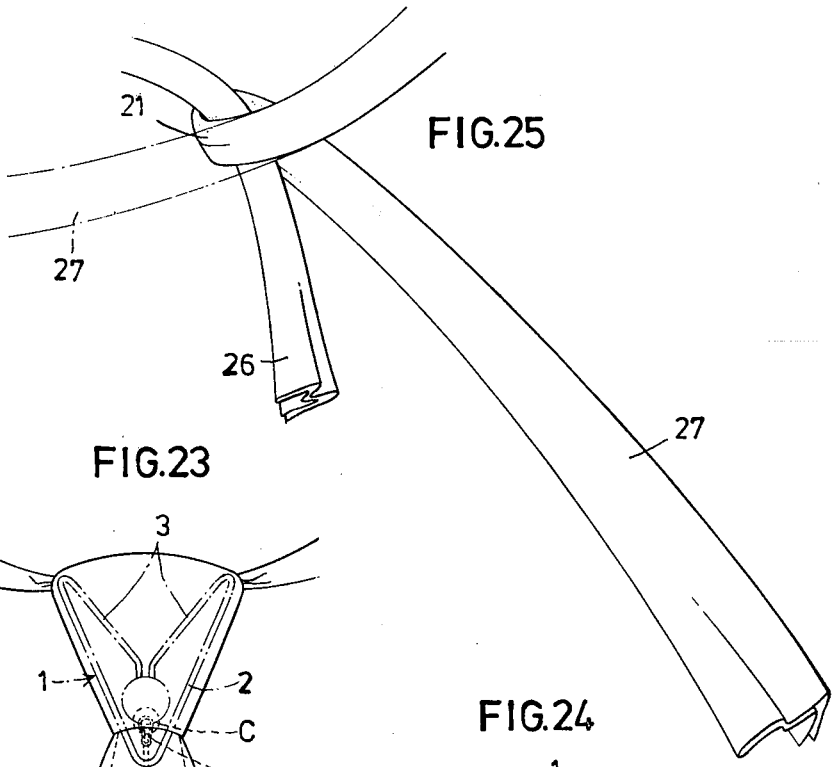
FIG.25
FIG.23
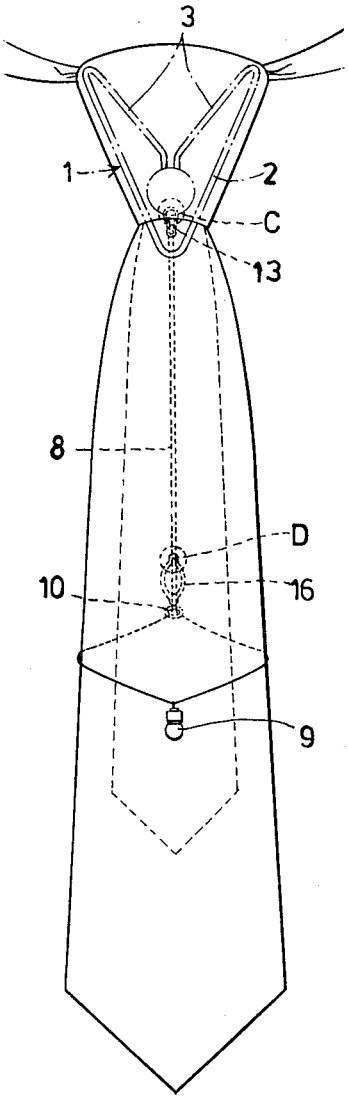
FIG.24
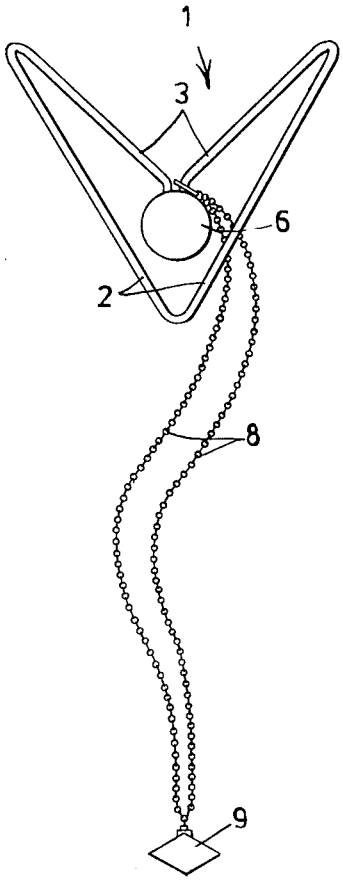

KNOT RETAINING IMPLEMENT FOR NECKTIE OR SCARF

BACKGROUND AND SUMMARY OF THE INVENTION

The present invention relates to a knot retaining implement for necktie or scarf.

It is often difficult to quickly tie a good looking knot in necktie, scarf or neckerchief, the knot naturally loosens and becomes untidy.

It is, therefore, an object of the present invention to provide a knot retaining implement for retaining a knot in a necktie, scarf or neckerchief in a tidy shape.

BRIEF DESCRIPTION OF THE DRAWINGS

Other objects and feature of the present invention will be apparent from the following description of the invention with reference to the accompanying drawings, in which:

FIG. 23 is an elevational view showing the manner of use of the implement of FIG. 22;

FIG. 24 is an elevational view of an implement suitable for a scarf; and

FIGS. 25 through 28 are elevational views showing the manner of use of the implement of FIG. 24.

DETAILED DESCRIPTION OF THE INVENTION

Figure 1:
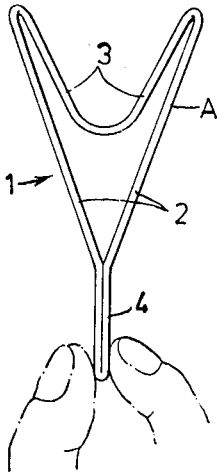
FIG. 1 is an elevational view illustrating a first embodiment of a knot retaining implement according to the present invention.

Throughout the drawings, similar parts and elements are designated by the similar reference numerals.

Figure 2:
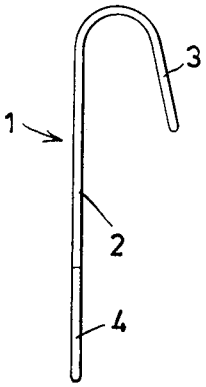
FIG. 2 is a side view of the implement shown in FIG. 1.

Referring now to FIGS. 1 and 2, a knot retaining implement 1 of the invention comprises a substantially V-shaped retaining portion 2 and a hook portion 3 which integrally extends backwardly from each end of the V-shaped portion 2. The implement 1 may be made from aluminium, copper or iron wire.

Figure 3:
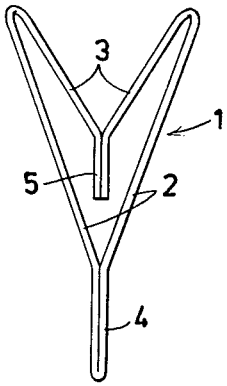
FIGS. 3 and 4 show modifications of the implement of FIG. 1.
Figure 4:
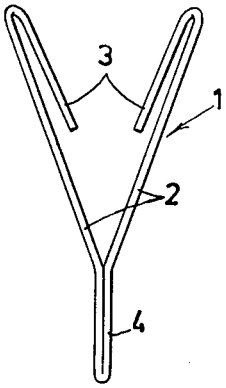
Figure 5:
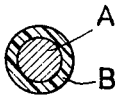
FIGS. 5 and 6 are cross-sectional views of the implement of the invention.
Figure 6:
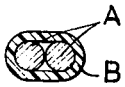

The lower end of the retaining portion 2 can be joined together as shown at 4 for the ready handling by the fingers. Similarly, as shown at 5 in FIG. 3, the lower end of the hook portion 3 can also be joined. The hook portion 3 may be continuous as shown in FIGS. 1 and 3, or may be discontinuous as shown in FIG. 4.

The wire A for forming the implement 1 of the invention can be coated or covered with a synthetic resin layer B. If desired, the wire A may be a strand of more than two wires.

Figure 7:
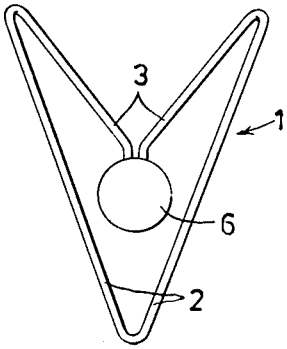
FIG. 7 is an elevational view illustrating a further modification of the implement of the invention.
Figure 8:
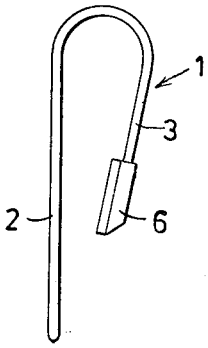
FIG. 8 is a side view showing the implement of FIG. 7.

As shown in FIGS. 7 and 8, a piece 6 of disk or any other shape can be fixed to the lower end of the hook portion 3. On the surface of the piece 6, a mark, letter or any other patterns may be drawn for the purpose of ornament.

As appears from FIG. 8, the space between the hook portion 3 and retaining portion 2 preferably is smaller towards the end of the hook portion 3.

Figure 9:
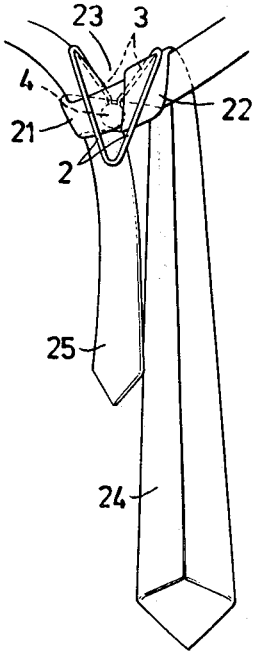
FIGS. 9 through 11 are elevational views showing the manner of use of the implement of the invention.
Figure 10:
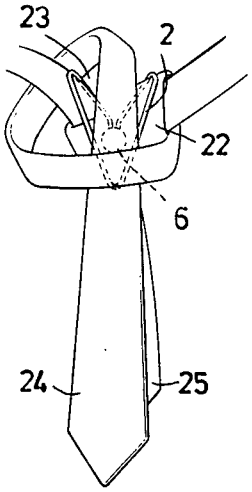
Figure 11:
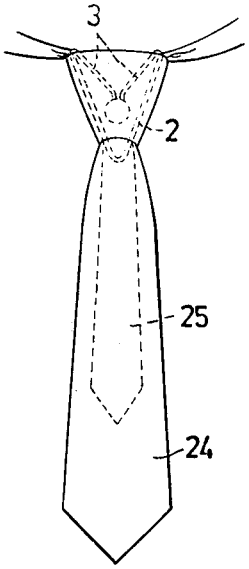

Referring to FIGS. 9 through 11, the manner for using the implement 1 of the invention will be explained by way of an example of so-called semi-Windsor type of knot.

At first, as shown in FIG. 9, a necktie is looped at one end about the other to form windings 21 and 22, with a crossing part 23 therebetween. At this time, a wider portion 24 of the necktie is inside out. The implement of the invention is then placed on the crossing part 23 so that the retaining portion 2 positions at the front, while the hook portion 3 positions at the back, thereby retaining the windings 21 and 22 between the portions 2 and 3 of the implement.

Next, as shown in FIG. 10, the wider end 24 is looped about the crossing part 23, and turned forward over the part 23 into the loop thus formed. The end 24 is then pulled downward while being guided between the wires of the V-shaped retaining portion 2, thus forming a knot as shown in FIG. 11.

In the case of the implement 1 of the invention having a disk-like piece 6 fixed on the end of the hook portion 3, when the implement 1 is put on the crossing part 23 as shown in FIG. 10, the crossing part 23 is stably supported by the flat face of the piece 6 at the back of the part 23. In addition, the retaining portion 2 and hook portion 3 clamp the windings 21 and 22, thus preventing the windings from loosening, and therefore, making the succeeding tying steps very easy.

As mentioned above, since the implement of the invention serves as a guide as well as a core for a knot, a person can easily and quickly tie a good looking knot, which is kept in the shape for a long while without loosening. In addition, when the implement is made from plastic wire such as copper or aluminium wire, width of the V-shaped portion 2 can be adjusted so as to meet the desired size of knot. Further, after tying a knot, the size thereof can be adjusted by widening or contracting the V-shaped portion 2.

Figure 12:
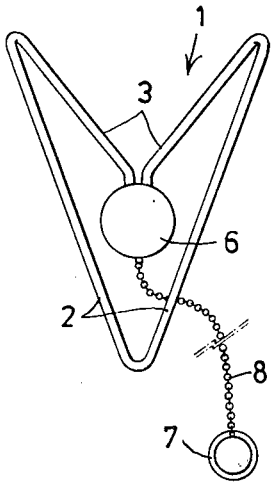
FIG. 12 is an elevational view of another modification of the implement of the invention.
Figure 13:
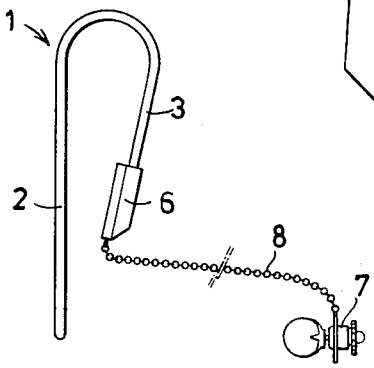
FIG. 13 is a side view of the implement of FIG. 12.

FIGS. 12 and 13 illustrate the implement with a chain 8 and a known tie tack 7. The chain 8 is connected to the end of the hook portion 3 or to the disk 6. The tie tack may be of any structure.

Figure 14:
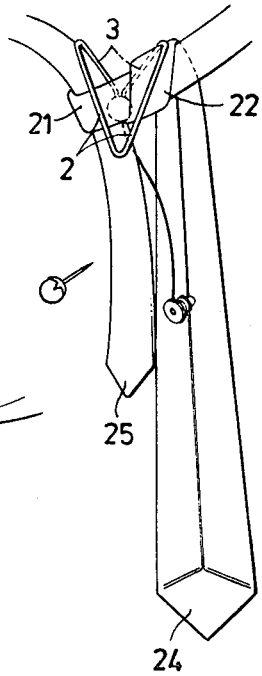
FIGS. 14 through 16 are elevational views showing the manner of use of the implement of FIGS. 12 and 13.
Figure 15:
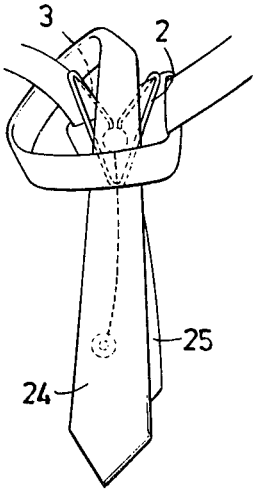
Figure 16:
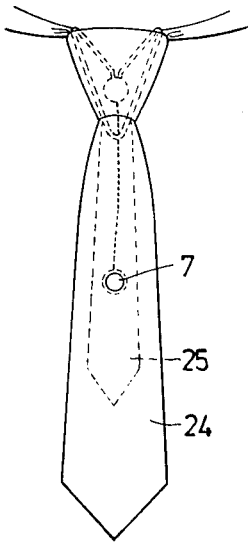

Upon using the implement of FIGS. 12 and 13, a knot is tied in the same manner as before, as shown in FIGS. 14 through 16. Thereafter, a pin of the tack 7 is pushed through the wider end 24 and narrower end 25 into a receiving member of the tack 7, whereby the necktie is kept tidy.

Figure 17:
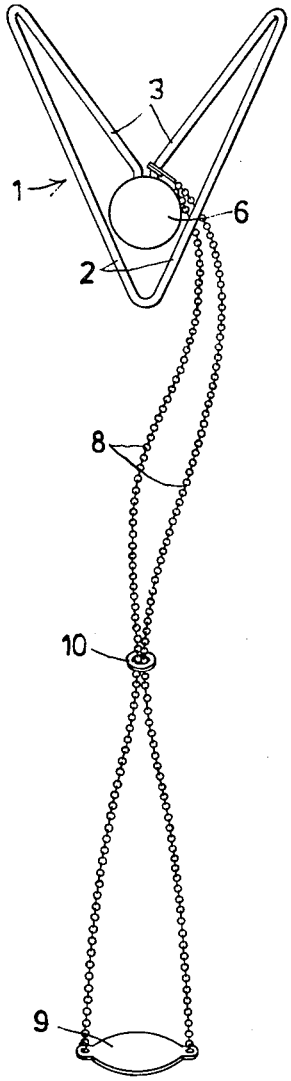
FIG. 17 is an elevational view illustrating a still further modification of the implement of the invention.
Figure 19:
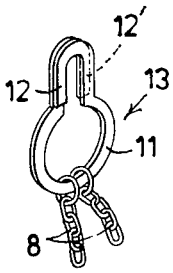
FIG. 19 is an enlarged perspective view showing a connection ring attached to a hook portion of the implement of the invention.
Figure 18:
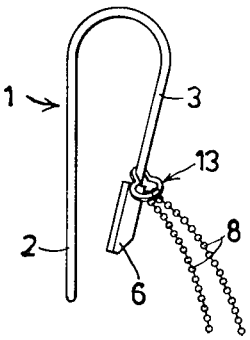
FIG. 18 is a fragmentary side view of the implement of FIG. 17.

FIGS. 17 through 19 show a further modification of the implement of FIG. 12. A looped chain 8 is connected at one end to the end of the hook portion 3. A ring 10 is fitted about the chain. A stop 9 is connected to the other end of the chain 8 so as to prevent removal of the ring 10. The stop 9 serves also as an ornament.

The chain 8 may be detachably connected to the end of the hook portion 3 so as to be separately usable. As shown in FIGS. 18 and 19, the chain 8 is connected to a connecting ring 13, which is in turn detachably connected to the end of the hook portion 3. The ring 13 is formed by a resilient wire 11 into a shape of keyhole so that ends 12, 12' overlaps one on the other. The overlapping portion is openable or separable so as to permit the end of the hook portion 3 to engage, as shown. For the separate use of the chain 8, the ring 13 is hooked about a button of a shirt.

Figure 20:
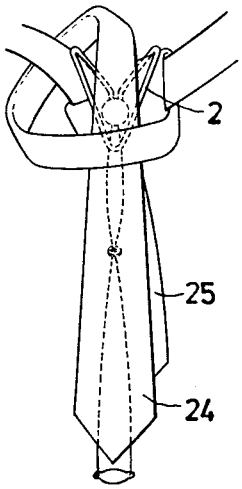
FIGS. 20 and 21 are elevational views illustrating the manner of use of the implement of FIG. 17.
Figure 21:
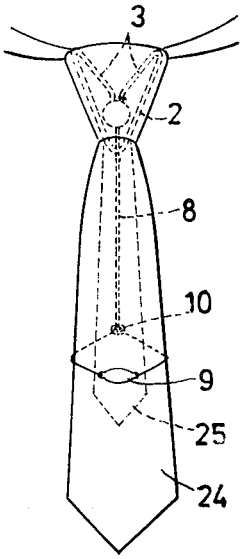

As shown in FIGS. 20 and 21, after the knot is completed, the chain 8 is wound about the ends 24 and 25 of the necktie, and the loop is reduced by sliding the ring 10, whereby the ends 24 and 25 will not separate and the tie is kept tidy.

Figure 22:
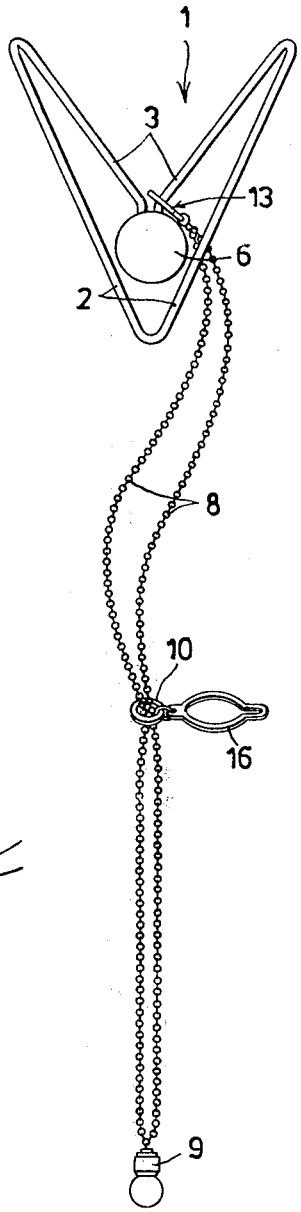
FIG. 22 is an elevational view showing a slight modification of the implement of FIG. 17.

FIG. 22 illustrates a slight modification of the implement of FIG. 17. As shown, the ring 10 has a connecting ring 16 for the engagement with a button of a shirt. The ring 16, however, may be of any structure so far as it can be connected to a button. The rings 10 and 16 can be formed integrally.

FIG. 23 shows the manner of separate use of the implement 1 and the chain 8. As shown, the ring 13 is engaged with an upper button C of a shirt so as to hang the chain 8. The ends of the tie are inserted in the loop of the chain 8. The loop is then reduced by sliding the ring 10. The ring 16 is then engaged with a lower button D, whereby the tie will not sway and is kept tidy.

Meanwhile, like a necktie, it is laborious to wear a scarf or neckerchief in presentable manner, and what is worse, the scarf is soon out of shape. In order to prevent this, a scarf or neckerchief is held by pins or clips at the point for keeping the shape. The implement of the invention can be also used for a scarf or the like. Any implement shown in FIGS. 1 through 23 may be used. However, the implement shown in FIG. 24 is preferable. The implement is almost the same as that of FIG. 17. As appears, the looped chain 8 is connected to the end of the hook portion 3, and has the ornament 9 at the center of the loop. As seen, the ring 10 of FIG. 17 is omitted.

Figure 26:
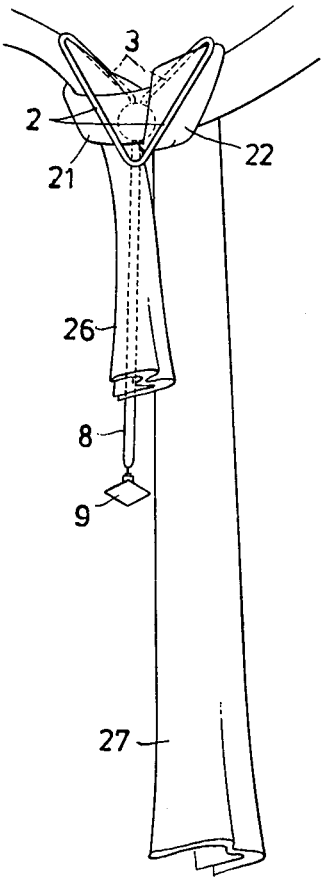

FIGS. 25 through 28 illustrate the manner of use of the implement of FIG. 24. Initially, a scarf is wound about a neck so that ends 26 and 27 cross as shown by the dot-dash lines. One end 27 is then turned backward to form a winding 21, and further looped from the front to the back to form a winding 22 as shown in FIG. 26. Thereafter the implement 1 is mounted on the crossing part of the scarf so that the retaining portion 2 and hook portion 3 retain the windings 21 and 22 by clamping the front and back thereof with wires of the portions 2 and 3, thus preventing the windings 21 and 22 from loosening.

Figure 27:
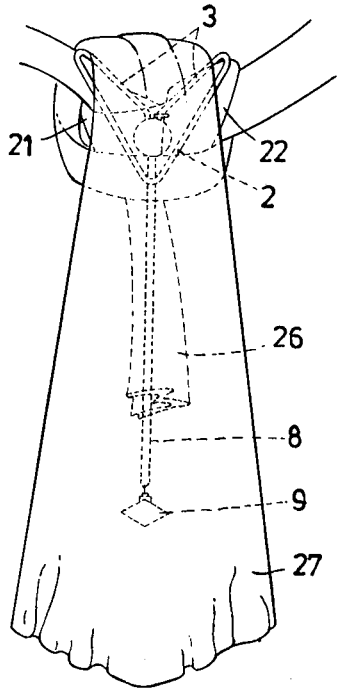

The end 27 is then wound about the end 26 as shown by the dotted line in FIG. 27, and turned to the front so as to overlap on the end 26.

Figure 28:
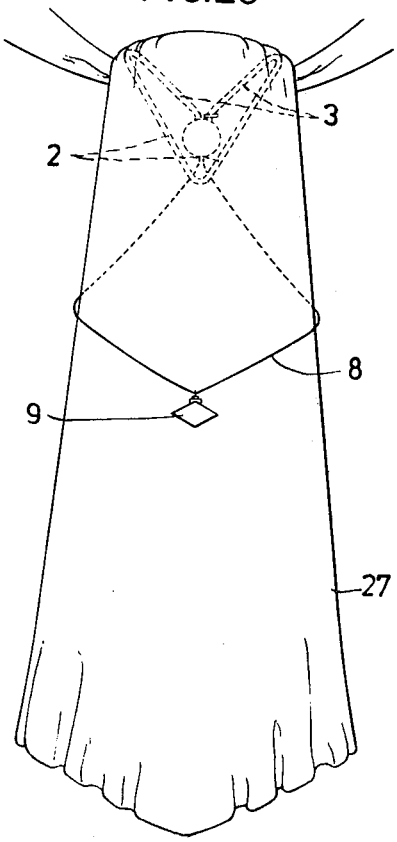

Finally, the ends 26 and 27 are inserted into the loop of the chain 8. The end 27 is spread laterally to be of a wider, voluminous shape, as shown in FIG. 28.

What is claimed is:

1. A knot retaining implement for a necktie and a scarf comprising:
   - a substantially v-shaped wire retaining portion;
   - a hook portion integrally formed with and extending backwardly from the ends of said v-shaped portion;
   - a single looped chain for fitting around said tie connected to said hook portion and extending therefrom;
   - a slidable ring fitted around the outside of said chain; and
   - a stop connected to said chain, whereby positioning said tie through said chain with said stop in front of said tie and lowering said slide ring on said chain folds said tie between said stop and said ring.

2. A knot retaining implement as claimed in claim 1, further comprising a piece fixed to the outer end of the hook portion.

3. A knot retaining implement as claimed in claim 1, wherein the chain is detachably connected to the hook portion.

4. A knot retaining implement as claimed in claim 1, wherein the ring has another ring so as to be engageable with a button of a shirt.

* * * * *

UNITED STATES PATENT AND TRADEMARK OFFICE

CERTIFICATE OF CORRECTION

PATENT NO. : 4,173,793

DATED : November 13, 1979

INVENTOR(S) : Kazuo Yasui

It is certified that error appears in the above-identified patent and that said Letters Patent are hereby corrected as shown below:

On the title page, change the inventor's name from "Yasui Kazuo" to -- Kazuo Yasui --.

Signed and Sealed this

*Fourth* Day of *March 1980*

[SEAL]

*Attest:*

SIDNEY A. DIAMOND

*Attesting Officer*

*Commissioner of Patents and Trademarks*